US007913437B2

(12) United States Patent
Domenig et al.

(10) Patent No.: US 7,913,437 B2
(45) Date of Patent: Mar. 29, 2011

(54) ROOM OCCUPANCY INDICATOR

(76) Inventors: Caroline Simmen Domenig, Kernersville, NC (US); Robert Leonard Simmen, Mt. Albert (CA); Colette Simmen Fischer, Lommiswil (CH); Pierre Willy Simmen, Fuquay-Varina, NC (US)

( * ) Notice: Subject to any disclaimer, the term of this patent is extended or adjusted under 35 U.S.C. 154(b) by 128 days.

(21) Appl. No.: 12/346,048

(22) Filed: Dec. 30, 2008

(65) Prior Publication Data

US 2010/0006021 A1 Jan. 14, 2010

Related U.S. Application Data

(63) Continuation-in-part of application No. 11/951,603, filed on Dec. 6, 2007, now abandoned.

(51) Int. Cl.
*G09F 11/04* (2006.01)

(52) U.S. Cl. ..... 40/495; 40/907; 116/298; 116/309; 116/315

(58) Field of Classification Search ..... 40/495, 40/907; 116/284, 298, 309, 315
See application file for complete search history.

(56) References Cited

U.S. PATENT DOCUMENTS

| | | | | | |
|---|---|---|---|---|---|
| 345,339 | A * | 7/1886 | Vail | 40/460 |
| 680,515 | A * | 8/1901 | Wood | 116/67 R |
| 747,252 | A * | 12/1903 | Smith | 40/460 |
| 1,255,909 | A * | 2/1918 | Monasch | 40/495 |
| 1,294,433 | A * | 2/1919 | Evers | 235/91 C |
| 1,358,698 | A * | 11/1920 | Beskow | 235/128 |
| 1,393,149 | A * | 10/1921 | Matchette | 40/460 |
| 2,565,669 | A * | 8/1951 | Smith | 116/290 |
| 2,902,784 | A * | 9/1959 | Sukul | 40/486 |
| 3,017,087 | A * | 1/1962 | Bodeen | 235/122 |
| 3,672,081 | A * | 6/1972 | Bergeron | 40/495 |
| 4,854,061 | A * | 8/1989 | Khoshkish | 40/495 |
| 6,789,497 | B1 * | 9/2004 | Aiken | 116/308 |

* cited by examiner

*Primary Examiner* — Gary C Hoge
(74) *Attorney, Agent, or Firm* — Novak Druce & Quigg LLP

(57) ABSTRACT

A tamper-resistant indicator is disclosed. The indicator includes a front panel configured to be located on an outside surface of a door. The indicator also includes a back panel configured to be located on an inside surface of the door. The indicator also includes a turning indicator, including a springy living hinge, wherein said turning indicator has a front part disposed on the front panel and a back part disposed on the back panel, and the two parts communicate with each other via a rotatable axis or shaft member configured to pass through an opening bored through the door, and wherein the axis or shaft member is coupled between the front and back parts of the indicator, such that rotation of the back part of the indicator rotates the axis or shaft member, which in turn rotates the front part of the indicator.

9 Claims, 2 Drawing Sheets

ROOM OCCUPANCY INDICATOR

CROSS REFERENCE TO RELATED APPLICATIONS

This application is a continuation in part of application ROOM OCCUPANCY INDICATOR, Ser. No. 11/951,603 filed Dec. 6, 2007 now abandoned.

FIELD OF THE INVENTION

The present invention relates generally to the field of information displaying devices, and more particularly to a room occupancy indicator.

BACKGROUND OF THE INVENTION

Presently, room (hotel room, bathroom, meeting room, conference room, office) occupancy indicators, such as "Do Not Disturb" cards or signs are hung, for example, on the outer door knobs of rooms of establishments, such as hotels, motels, inns and the like, or of conveyances, such as trains, cruise ships and the like, to indicate that such rooms are occupied by guests, who for one reason or another do not wish to have staff, such as a cleaner, enter the room. For example, a guest may not want to be disturbed because he or she is taking a bath, dressing or simply sleeping late. Such "Do Not Disturb" cards or signs can, for example, be unintentionally or inadvertently turned over to "Clean Room" or vice versa) or intentionally switched or removed, for example, by pranksters or small children, who may not know better. This situation can lead to embarrassing moments for guests, as well as for well-meaning staff

SUMMARY OF THE INVENTION

It is a feature and advantage of the present invention to provide an effective and inexpensive room occupancy indicator that resists either inadvertent or intentional tampering.

To achieve the stated and other features, advantages and objects, embodiments of the present invention provide a tamper-resistant room occupancy indicator with a front panel, with or without a clear cover, located on an outside surface of a door, a back panel located on the inside surface of the door, and a turning indicator. The turning indicator has a front part disposed on the front panel and a back part disposed on the back panel, and the two parts communicate with one another via a rotatable axis or shaft member that passes through an opening bored through the door. The axis or shaft member is coupled between the front and back parts of the indicator, such that rotation of the back part of the indicator rotates the axis or shaft member, which in turn rotates the front part of the indicator.

When the indicator is rotated, a springy living hinge mechanism made in one-piece will collapse until the new message appears (for example "Do Not Disturb") catching the new message into place. When the indicator is rotated the opposite way, it collapses the springy living hinge mechanism until the other message (for example "Clean Room") appears and catches into place so that it does not move freely and is engaged into place. A third, message may be placed on the indicator at the top of the indicator between the other two messages. Each time the indicator is rotated to select a message, this is accompanied by a soft "click".

Additional objects, advantages and novel features of the invention will be set forth in part in the description which follows, and in part will become more apparent to those skilled in the art upon examination of the following, or may be learned from practice of the invention.

DETAILED DESCRIPTION

Figure 1:
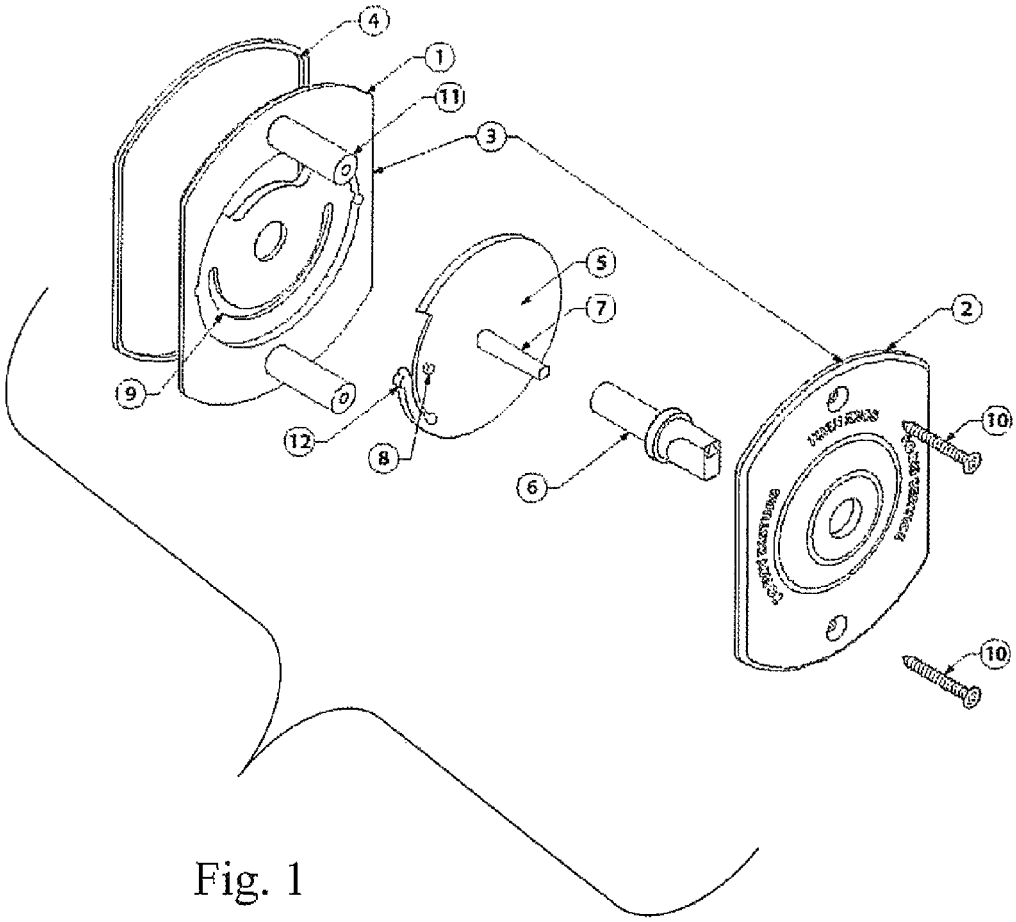
FIG. 1 illustrates an example of the tamper-resistant room occupancy indicator in a blown-up view.

Reference will now be made in detail to embodiments of the invention, one or more examples of which are illustrated in the accompanying attachments. Each example is provided by way of explanation of the invention, not as a limitation of the invention. It will be apparent to those skilled in the art that various modifications and variations can be made in the present invention without departing from the scope or spirit of the invention. For example, features illustrated or described as part of one embodiment can be used on another embodiment to yield a still further embodiment. Thus, it is intended that the present invention cover such modifications and variations that come within the scope of the invention.

While an example embodiment of the invention deals with a hotel as a typical application of the invention, it is to be understood that the invention is applicable to any buildings, structures, vehicles, or vessels (such as ships) containing one or more separates rooms.

Referring to the attachments, an embodiment of the invention provides a tamper-resistant room occupancy indicator that includes a front panel 1 located on an outside surface of a room door (i.e. the surface of the room door facing a corridor or hallway along which the room is approached from outside the room). In addition, a back panel 2 is located on the opposite or inside surface of the door and spaced apart from the front panel 1 by a distance equal to the thickness of the door 3. A clear cover 4 can be provided on the front panel 1 and/or back panel 2 if desired, but is not required.

In addition, the tamper-resistant occupancy indicator for embodiments of the invention includes, for example, a turning indicator with a rotatable front part 5 disposed on the front panel 1 and a rotatable back part 6 disposed on the back panel 2. When the indicator 5 is rotated, a springy living hinge mechanism 12 made in one-piece will collapse until the new message appears (for example "Do Not Disturb") catching the new message into place. The front and back parts 5, 6 of the turning indicator communicate with one another, for example, via a rotatable axis or shaft member 7 that passes through an opening formed or bored through the door. The axis or shaft member 7 is coupled between the front and back parts 5,6 of the indicator, such that rotation of the back part 6 of the indicator rotates the axis or shaft member 7, which in turn rotates the front part 5 of the indicator, A dimple 8 in the indicator fits into a groove 9 in the front panel in order to restrict the movement of the indicator; so that the indicator can only move from side to top to the other side (180°) and not all the way around (360°).

Referring further to attachments, in the example embodiment, the front panel 1 located on the outside surface of the door and the back panel 2 located on the inside surface of the door are mounted via screws 10 coupled to the front and back panels 11 and extending rough bore holes formed or drilled through the door. However, it will be apparent to those skilled in the art that it is not necessary for the front and back panels 1, 2 to be coupled to the same screws and that each can be mounted by its own separate fastening mechanism, such as screws and that each can be mounted by its own separate fastening mechanism, such as screws, tacks, nails, rivets, adhesives, and the like, to the respective inside and outside door surfaces, or for example, simply inscribed, painted or printed on the respective door surfaces.

Referring once more to the attachments, the indicator is imprinted with corresponding indicia or signs or occupancy, such as "Do Not Disturb," "Clean Room," "Meeting," or the like, such that the indicator 5 located on the back panel 1 of the front panel is disposed in a position, such as "Do Not Disturb," the indicator 5 located behind the front part 1 is disposed in the corresponding "Do Not Disturb" position. When the knob 6 on the back panel 2 is rotated to a second position, such as "Clean Room," the indicator 5 on the front part 1 is likewise rotated to the corresponding "Clean Room" position. Further, the indicator 5 on the front part 1 rotates only in response to the rotation of the knob 6 on the back part, and cannot be rotated by someone standing outside the room because the indicator is securely engaged in its position.

Further, the front and back panels 1, 2 can include signs, logos or advertisements that are made of paper, plastic, wood, metal or the like. In addition, the signs or indicia of occupancy can comprise digital displays. Still further, the rotatable axis or shaft member 7 coupled between the front and back parts 5, 6 of the turning indicator can be adjustable in length telescopically or can be supplied in various lengths to accommodate a thickness of a particular door.

In alternative embodiments, the front and back parts 5, 6 of the turning indicator can include microchips, and contact-less or wireless communication, such as radio frequency, can be used to communicate information about the rotation and position of the indicator, which can in turn be provided with motor means, such as an electric motor, to cause the indicator 5 to rotate in response to the information about the rotation of the knob on the back part 6 or other input at the back part.

Referring still again to the attachments, the example embodiment may include a cover 4 on the front panel 1 on the outside of the door. The cover 4 can be made of any transparent or see-through material, such as glass or plastic. Further, the front and/or back panels 1, 2 can take any suitable shape, such as round, free-form, square, rectangular, octagonal, oval, etc. and the turning indicator 5 is circular in shape. The knob can take any suitable form, including without limitation, a circle, arrow, marked knob or lever.

A living hinge is a thin flexible hinge (flexure bearing) made from plastic (rather than cloth, leather, or some other substance). A living hinge operates by bending, compressing, or otherwise changing the original shape of a piece of plastic. The plastic will attempt to return to its original shape and configuration. The plastic is said to have a "memory" in that the plastic returns to its original shape, if allowed. It is typically manufactured in an injection molding operation and if correctly designed and constructed, it can remain functional over the life of the part(s). Polyethylene and polypropylene are considered to be the best resins for living hinges, due to their excellent fatigue resistance.

Figure 2A:
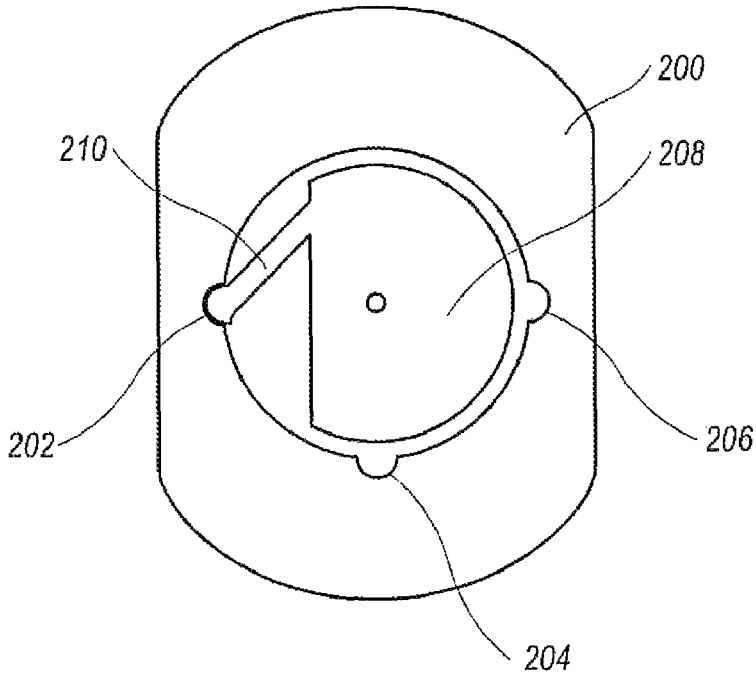
FIG. 2A illustrates a springy living hinge on a tamer-resistant room occupancy indicator in a first configuration.

FIG. 2A illustrates a springy living hinge incorporated into a room occupancy indicator. The inside surface of a back panel 200 is shown. The side of the back panel illustrated in FIG. 2A would lie against the outside surface of a door when fully installed. The back panel defines a cavity, the cavity including 3 stopping positions 202, 204, 206 for a springy living hinge 210. The springy living hinge 210 is connected to a turning indicator 208. The turning indicator 208 displays the desired occupancy status to the outside surface of a door on the opposite surface of that as shown in FIG. 2A. In this embodiment, when the springy living hinge 210 lies in position 202, a message of "Do Not Disturb" is presented on the opposite surface of the turning indicator.

A user may rotate the turning indicator 208 in a counter-clockwise motion. The springy living hinge 210 then compress as it exits stopping position 202. The springy living hinge will uncompress as it reaches stopping position 204. In this embodiment a user may continue to turn the turning indicator 208 in a counter-clockwise direction. The springy living hinge will again compress as it is rotated and then uncompress upon reaching stopping position 206.

Figure 2B:
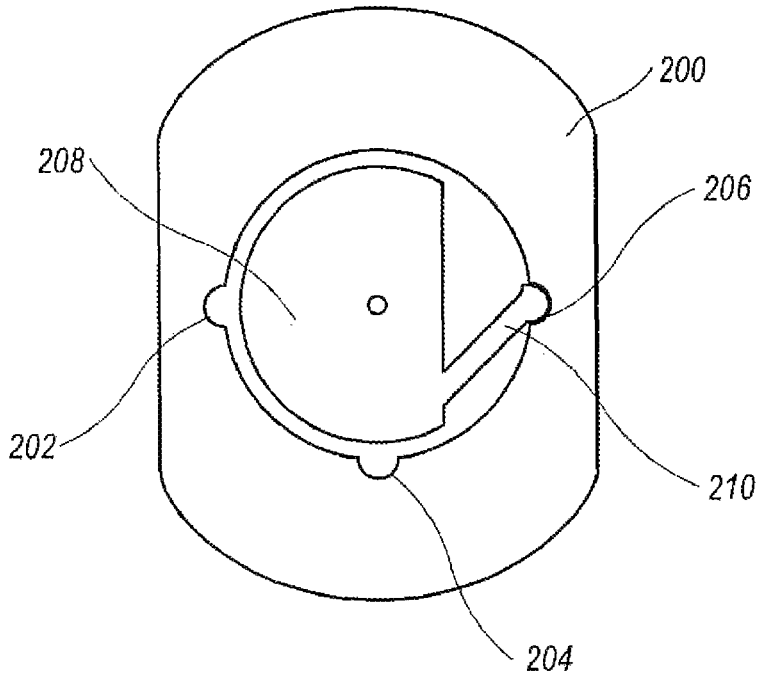
FIG. 2B illustrates the springy living hinge on the tamper-resistant room occupancy indicator of FIG. 2A in a second configuration.

FIG. 2B illustrates the springy living hinge 208 once it reaches stopping position 206 and uncompresses. The uncompressing of spring living hinge 208 causes the turning indicator 208 to display a corresponding message reading "Room Service Please". The room occupancy indicator will display this message in the present embodiment until a user applies a clockwise rotation to the turning indicator 208 causing the springy living hinge to compress and exit stopping point 206 until it reaches another stopping point along its path and uncompresses. Although in this embodiment, the middle stopping point has no corresponding message, other embodiments may include three, four, or more stopping points, each with a corresponding message.

Various preferred embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention.

What is claimed is:

1. A tamper-resistant indicator comprising:

a front panel configured to be located on an outside surface of a door, wherein the front panel defines a first aperture to view indicia on a turning indicator located between the outside surface and the front panel, and the front panel defines a groove on an inside surface thereof;

a back panel configured to be located on an inside surface of the door, the back panel defining a second aperture; and a unitary turning indicator, including a springy living hinge, wherein said turning indicator has a front surface including indicia and a back surface, a movement restrictor dimple that travels in said groove, thereby limiting rotation of the turning indicator to less than 360 degrees, and a shaft extending from the back surface through the aperture in the back panel, wherein rotation of the shaft rotates the unitary turning indicator.

2. A tamper-resistant indicator as in claim 1, further including a turning knob attached to the shaft.

3. A tamper-resistant indicator as in claim 1, wherein the unitary turning indicator is made of plastic.

4. A tamper-resistant indicator as in claim 1, wherein the front panel includes at least one post for accepting a screw and the back panel defines at least one aperture for receiving a screw, wherein the at least one aperture is alignable with the one post.

5. A tamper-resistant indicator as in claim 1, wherein the indicia includes the legends "Do Not Disturb" and "Room Service Please".

6. A tamper-resistant indicator as in claim 1, wherein the groove on the inside surface of the front panel is semi-circular and engages with the movement restrictor dimple.

7. A tamper-resistant indicator as in claim 1, wherein the front panel defines stopping points for engaging with the living hinge of the unitary turning indicator.

8. A tamper-resistant indicator as in claim 1, wherein the front panel, the back panel, and the turning indicator including the springy living hinge are all made from injection molded plastic.

9. A tamper-resistant indicator consisting essentially of:

a front panel configured to be located on an outside surface of a door, wherein the front panel defines a first aperture to view indicia on a unitary turning indicator and the front panel defines a groove on an inside surface thereof;

a back panel configured to be located on an inside surface of the door, the back panel defining a second aperture; and a unitary turning indicator, including a springy living hinge, wherein said turning indicator has a front surface including indicia and a back surface, a movement restrictor dimple, that travels in said groove, thereby limiting rotation of the turning indicator to less than 360 degrees, and a shaft extending from the back surface through the second aperture in the back panel, wherein rotation of the shaft rotates the unitary turning indicator.

* * * * *